US012041980B2

(12) United States Patent
Qin

(10) Patent No.: US 12,041,980 B2
(45) Date of Patent: Jul. 23, 2024

(54) NURSING BRA WITH ADHESIVE

(71) Applicant: Shenzhen Lutejiacheng Technology Co., Ltd., Shenzhen (CN)

(72) Inventor: E Qin, Shenzhen (CN)

(73) Assignee: Shenzhen Lutejiacheng Technology Co., Ltd., Shenzhen (CN)

( * ) Notice: Subject to any disclaimer, the term of this patent is extended or adjusted under 35 U.S.C. 154(b) by 126 days.

(21) Appl. No.: 17/842,832

(22) Filed: Jun. 17, 2022

(65) Prior Publication Data

US 2023/0371617 A1 Nov. 23, 2023

(30) Foreign Application Priority Data

May 17, 2022 (CN) ..... 202210535136.7

(51) Int. Cl.
*A41C 3/04* (2006.01)
*A41C 3/00* (2006.01)

(52) U.S. Cl.
CPC ..... *A41C 3/04* (2013.01); *A41C 3/0028* (2013.01)

(58) Field of Classification Search
CPC ..... A41C 3/04; A41C 3/0028
USPC ..... 450/86
See application file for complete search history.

(56) References Cited

U.S. PATENT DOCUMENTS 1,936,127 A * 11/1933 Dunlevy ..... A41F 15/002 2/323
2,109,345 A * 2/1938 Silverman ..... A41F 15/002 2/323
2,502,524 A * 4/1950 Keller ..... A41C 3/04 D2/709
2,529,774 A * 11/1950 Landau ..... A41B 9/16 2/323
2,657,392 A * 11/1953 Jackson ..... A41F 15/00 2/338
2,748,771 A * 6/1956 Richards ..... A41C 3/04 450/36
2,767,402 A * 10/1956 Pauk ..... A41C 3/04 604/385.07
2,849,723 A * 9/1958 Marino ..... A41F 15/005 2/337
D383,888 S * 9/1997 Smith ..... D2/624
6,163,937 A * 12/2000 McKinnis ..... A41F 15/02 2/323
6,179,687 B1 * 1/2001 Lee ..... A41F 15/002 450/88
6,186,861 B1 * 2/2001 Flaherty ..... A41F 15/002 450/86
6,346,027 B1 * 2/2002 Merkovsky ..... A41C 3/04 450/38

(Continued)

*Primary Examiner* — Gloria M Hale
(74) *Attorney, Agent, or Firm* — Bayramoglu Law Offices LLC

(57) ABSTRACT

A nursing bra with an adhesive design includes a bra body and pads. The bra body includes a front side and a back side. The pads are configured to shape breasts and prevent nipple show-through. The front side of the bra body is provided with two cup structures. The cup structures are provided with accommodating spaces. The pads are semi-fixed in the accommodating spaces. In the nursing bra, the pads can be taken out of the cup structures for cleaning and dried directly outside the bra to prevent growth of mold and bacteria, and they are prevented from shifting and curling by adhering positions, improving wearing comfort.

10 Claims, 3 Drawing Sheets

(56) References Cited

U.S. PATENT DOCUMENTS

| | | | | |
|---|---|---|---|---|
| 6,422,521 | B1 * | 7/2002 | Tinklepaugh | B60T 17/046 24/301 |
| 7,081,034 | B1 * | 7/2006 | Zoellner | A41C 3/04 2/104 |
| 7,314,400 | B2 * | 1/2008 | Fildan | A41F 15/002 450/86 |
| 9,345,274 | B1 * | 5/2016 | Prill | A41D 1/215 |
| 10,420,378 | B2 * | 9/2019 | Kosak | A61M 1/067 |
| 10,426,203 | B2 * | 10/2019 | Kosak | A41C 3/04 |
| 2012/0184179 | A1 * | 7/2012 | Blitz | A61M 1/067 450/36 |
| 2018/0352884 | A1 * | 12/2018 | Vanos | A41F 1/006 |
| 2020/0383393 | A1 * | 12/2020 | Caden | B32B 27/40 |
| 2021/0084996 | A1 * | 3/2021 | Ironi | A41C 3/04 |

* cited by examiner

NURSING BRA WITH ADHESIVE

CROSS REFERENCE TO THE RELATED APPLICATIONS

This application is based upon and claims priority to Chinese Patent Application No. 202210535136.7, filed on May 17, 2022, the entire contents of which are incorporated herein by reference.

TECHNICAL FIELD

The present disclosure relates to the technical field of nursing bras, and in particular to a nursing bra with an adhesive design.

BACKGROUND

Breasts of nursing women will leak milk, which will stain the bra pads. Rich in nutrients, breast milk can easily breed bacteria, causing breast tissue infection and affecting breast-feeding. Some existing nursing bras use freely detachable pads, which are convenient for thorough cleaning and drying. However, the pads need to be reset to the correct position before wearing, making it inconvenient for wearing. In addition, the pads may move and curl, causing discomfort during wear. Some existing nursing bras use fixed pads, which are not easy for thorough cleaning. In addition, since the pads cannot be taken out of the cup structures for drying, mold and bacteria are likely to grow in the humid cup structures, seriously threatening the health of nursing moms and babies.

SUMMARY

To solve the above-mentioned problems, the present disclosure adopts the following technical solution:

A nursing bra with an adhesive design includes a bra body and pads, where the bra body includes a front side and a back side; and the pads are configured to shape breasts and prevent nipple show-through;

the front side of the bra body is provided with two cup structures; the cup structures are provided with accommodating spaces; and the accommodating spaces have a shape matched with the pads; and the pads are semi-fixed in the accommodating spaces.

Preferably, the pads may be teardrop-shaped to shape the breasts.

Preferably, the cup structures may be provided with openings, through which the pads may be taken out or put in.

Preferably, the pads may be adhered to bottom edges of the accommodating spaces.

Preferably, the bra body may be formed by adhering two fabrics, namely a fabric located at the front side of the bra body and a fabric located at the back side of the bra body.

Preferably, the bra body may further include straps; the straps and the cup structures may be connected or disconnected through nursing clips; and the straps may be connected to top ends of the back side of the bra body.

Preferably, the front side and the back side may be connected; two ends of a connecting line between the front side and the back side may be each sewn by bar tack; and a strengthening bar may be provided on a back side of the connecting line to improve a structural strength.

Preferably, the bra body may further include a W-shaped support; and the W-shaped support may be located below the cup structures to support the cup structures.

Preferably, the bra body may further include slings; and each of the slings may have one end connected to the nursing clip and the other end connected to a bottom of the bra body, and may be configured to connect and stabilize the strap.

Preferably, the bra body may further include a double-clip structure composed of two nursing back clips; one end of one nursing back clip may be connected to the strap, and one end of the other nursing back clip may be connected to the sling; and ends of the two nursing back slips without being connected to the bra body may be connected together.

The present disclosure has the following beneficial effects. In the present disclosure, the semi-fixed pads can be taken out of the cup structures for cleaning and dried directly outside the bra to prevent the growth of mold and bacteria. It only requires the pads be put into the cup structures before wearing, and the adhering positions can help accurately and quickly reset the pads to the correct positions. The adhering positions can also prevent the pads from shifting and curling, improving wearing comfort.

REFERENCE NUMERALS

Figure 1:
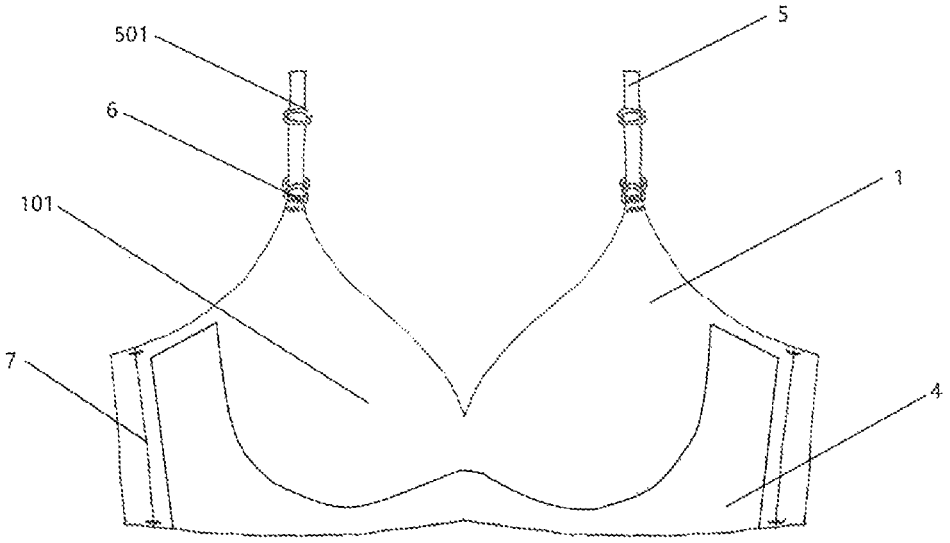
FIG. 1 is an outside view of a front side of a nursing bra with an adhesive design according to the present disclosure.
Figure 2:
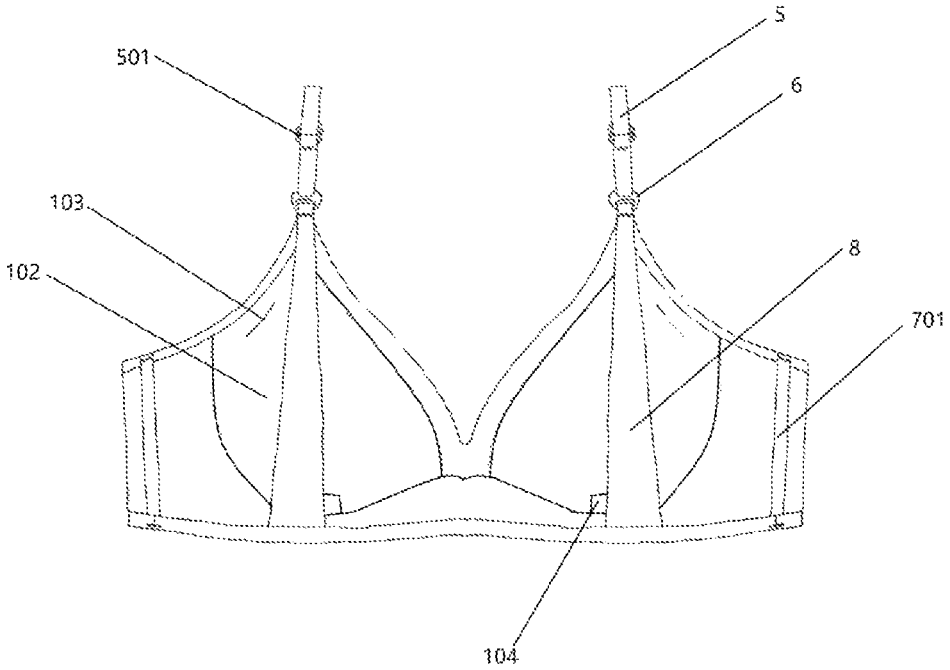
FIG. 2 is an inside view of the front side of the nursing bra with an adhesive design according to the present disclosure.
Figure 3:
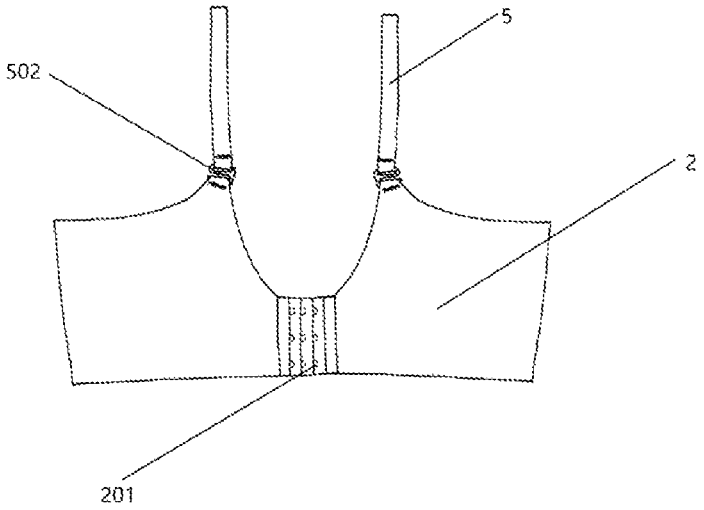
FIG. 3 is an outside view of a back side of the nursing bra with an adhesive design according to the present disclosure.
Figure 4:
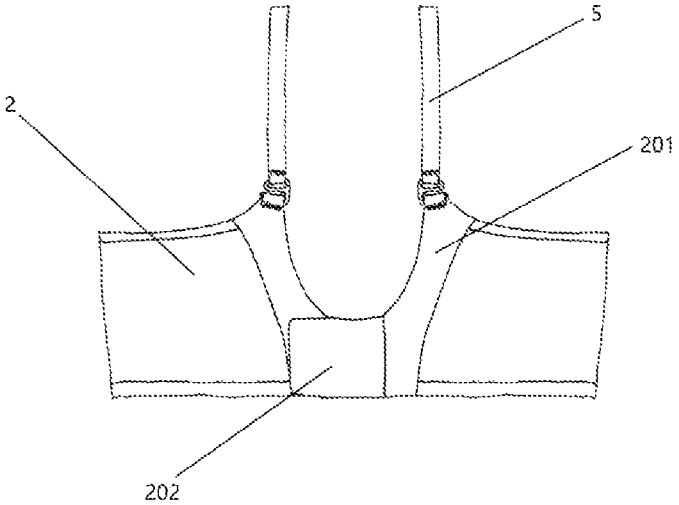
FIG. 4 is an inside view of the back side of the nursing bra with an adhesive design according to the present disclosure.
Figure 5:
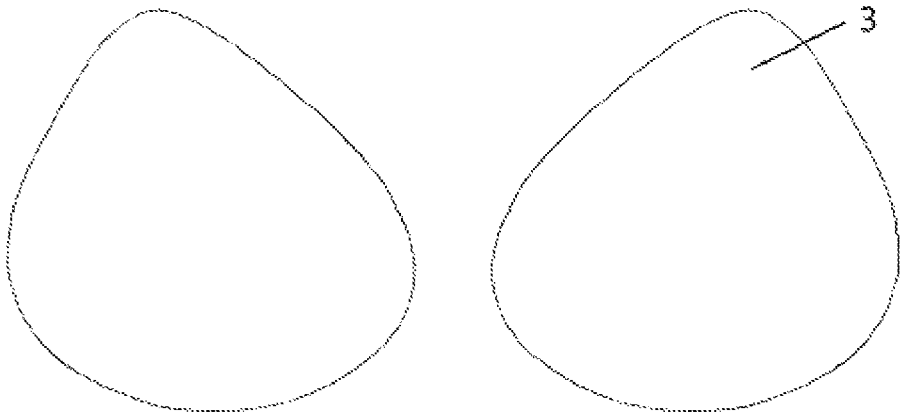
FIG. 5 is a front view of pads of the nursing bra with an adhesive design according to the present disclosure.

1. front side; 101. cup structure; 102. accommodating space; 103. opening; 104. adhering position; 2. back side; 201. back strengthening bar; 202. clasp; 3. pad; 4. W-shaped support; 5. strap; 501. adjuster; 502. figure 9-shaped clip; 6. nursing clip; 7. connecting line; 701. strengthening bar; and 8. sling.

DETAILED DESCRIPTION OF THE EMBODIMENTS

The present disclosure is further described in detail below with reference to the drawings and embodiments of the present disclosure.

Embodiment 1

In this embodiment, the nursing bra with an adhesive design includes a bra body and pads (3). The bra body includes a front side (1) and a back side (2). The back side (2) includes back strengthening bars (201). The back strengthening bars (201) are located on an inner side of the back side (2) of the bra body to improve a structural strength of the bra body.

The pads (3) are configured to shape breasts and prevent nipple show-through.

The front side (1) of the bra body is provided with two cup structures (101). The cup structures (101) are provided with accommodating spaces (102). The accommodating spaces (102) have a shape matched with the pads (3). Double sides of each of the cup structures (101) are made of elastics.

The pads (3) are semi-fixed in the accommodating spaces (102). Further, the pads (3) are fixed by adhering. Nursing women's breasts expand by 20%-30% in 2-3 hours. The cup structures (101) are made of elastics, and the pads (3) are inserted. If the pads are fully fixed, it will limit the stretch of the cup structures (101), thereby squeezing the expanded breasts and causing breast pain. If the pads are not fixed, the pads will shift and curl during washing and wearing, reducing the inconvenience and discomfort of the nursing bra.

Embodiment 2

In this embodiment, as a further improvement of the technical solution of Embodiment 1, the pads (3) are teardrop-shaped to gather the breasts. Further, the pads (3) are made of a comfortable, breathable soft material, which improves the wearing comfort.

Embodiment 3

In this embodiment, as a further improvement of the technical solution of Embodiment 1, the cup structures (101) are provided with openings, through which the pads (3) are taken out or put in. Further, the openings (103) are provided at an inner fabric of the cup structures (101), close to a side edge of the bra body, and has a length of 3-4.5 cm. Nursing women will spring a leak, which will stain the bra. To thoroughly clean the pads (3), the pads (3) are taken out of the accommodating spaces (102).

Embodiment 4

In this embodiment, as a further improvement of the technical solution of Embodiment 1, the pad (3) is adhered to a bottom edge of the accommodating space (102) through an adhering position (104). When the nursing bra is washed, the pad (3) curls at a connection between the elastic cup structure (101) and a W-shaped support (4). The lower edge of the cup structure (101) has a small curvature. Therefore, the pad (3) is adhered to the lower edge of the accommodating space (102) in the cup structure (101), thereby increasing the adhesion area and making the pad (3) stable.

Embodiment 5

In this embodiment, as a further improvement of the technical solution of Embodiment 1, the bra body is formed by adhering two fabrics. One fabric is located at a front side of the bra body, and the other fabric is located at a back side of the bra body. The breasts of nursing women will change in size in a short period of time, so the fabrics of the bra body are made of elastics.

Embodiment 6

In this embodiment, as a further improvement of the technical solution of Embodiment 1, the bra body further includes straps (5). The straps (5) and cup structures (101) of the bra body are connected or disconnected through nursing clips (6). Nursing women only need to unhook the nursing clip (6) to breastfeed in time. The straps are designed with a wide structure to reduce the pressure on the shoulders, so as to prevent bruises. The straps (5) are provided with adjusters (501) for adjusting a length of the straps. Further, the adjusters (501) are figure 8-shaped clips.

The straps (5) of the bra body are connected to top ends of the back side (2) of the bra body. Further, the straps are connected to the back side of the bra body through figure 9-shaped clips (502). The back side (2) is further provided with clasps (202) for adjusting tightness of the bra body on the under bust girth. Each of the back strengthening bars (201) has one end fixedly connected to a connection between the strap (5) and the back side (2) of the bra body and the other end fixedly connected to a bottom end of the back side (2) of the bra body. The back strengthening bars are designed to reduce breakage and deformation and avoid bruises.

Embodiment 7

In this embodiment, as a further improvement of the technical solution of Embodiment 1, the front side (1) and the back side (2) are fixedly connected. Two ends of a connecting line (7) between the front side and the back side are each sewn by bar tack. A strengthening bar (701) is provided on a back side of the connecting line to improve a structural strength. The connecting line between the front side and back side is in an underarm position. When the upper limbs move or the breasts expand, the connecting line (7) is pulled, and the two ends of the connecting line (7) receives a greatest pulling force. Therefore, it is necessary to design strengthening structures at two ends of the connecting line. The strengthening bar (701) improves the stability of the connecting line and prevents the backflow of underarm fat.

Embodiment 8

In this embodiment, as a further improvement of the technical solution of Embodiment 1, the bra body further includes a W-shaped support (4). The W-shaped support (4) is located below the cup structures (101) to support the cup structures (101). Two wings of the W-shaped support (4) are raised to cover outer arc edges of the cup structures (101), so as to provide a lateral pushing and gathering force from an outer side to a center. The center of the W-shaped support (4) is raised to cover inner arc edges of the cup structure (101), and is configured to position the pads so as to shape round breasts. When the center of the W-shaped support (4) is raised, there is still a space between the two cup structures (101) to be filled with an elastic. In this way, when the breasts continue to expand in 2-3 hours, the nursing bra can stretch laterally to provide room, so as to ensure wearing comfort.

Embodiment 9

In this embodiment, as a further improvement of the technical solutions of Embodiments 1 and 6, the bra body further includes slings (8). Each of the slings (8) has one end connected to the nursing clip (6) and the other end connected to a bottom of the bra body, and is configured to connect and stabilize the strap. Further, the slings (8) are made of an elastic and have a wide structure, so as prevent the slings (8) from compressing and bruising the breasts. An end of the sling (8) connected to the bottom of the bra body is widened to increase the connection area. In this way, the pulling force of the sling (8) to the bottom of the bra body is evenly distributed, thereby reducing the deformation of the joint at the bottom of the bra body.

Embodiment 10

In this embodiment, as a further improvement of the technical solution of Embodiment 1, the bra body further includes a double-clip structure composed of two nursing back clips. In the double-clip structure, one end of one nursing back clip is connected to the strap, and one end of the other nursing back clip is connected to the sling (8). Ends of the two nursing back slips without being connected to the bra body are connected together. Further, the two nursing back clips are connected together through a nursing strap made of a material similar to that of the strap.

In the description of the present disclosure, it should be understood that terms such as "upper", "lower", "front", "rear", "left", "right", "central", "top", "bottom", "top portion", "bottom portion", "inside", "outside", "inner side" and "outer side" are intended to indicate the orientation or position relationships based on the drawings. They are merely intended to facilitate and simplify the description of the present disclosure, rather than to indicate or imply that the mentioned device or components must have the specific orientation or must be constructed and operated in the specific orientation. Therefore, these terms should not be understood as a limitation to the present disclosure. The "inside" refers to an interior or enclosed region or space, and the "outside" refers to a region surrounding a particular component or particular region.

It should be understood that, in the description of the embodiments of the present disclosure, unless otherwise specified, the phrases "provided with", "connected", "connection" and "assembled" should be comprehended in a broad sense. For example, "connection" may be a fixed connection, a detachable connection or an integrated connection, may be a direct connection or an indirect connection via a medium, or may be intercommunication between two components. Those of ordinary skill in the art may understand the specific meanings of the above terms in the present disclosure based on the specific situation.

In the description of the embodiments of the present disclosure, the specific features, structures, materials or characteristics may be combined in any suitable manner in any one or more embodiments or examples.

It should be understood that, in the description of the embodiments of the present disclosure, "-" and "to" are used to represent a range between two numerical values, and the range includes the endpoints. For example: "A-B" means a range greater than or equal to A and less than or equal to B, and "A to B" means the range greater than or equal to A and less than or equal to B.

It should be understood that, in the description of the embodiments of the present disclosure, the term "and/or" merely describes associations between associated objects, and it indicates three types of relationships. For example, A and/or B may indicate that A alone, A and B, or B alone. In addition, the character "/" in this specification generally indicates that the associated objects are in an "or" relationship.

Although the embodiments of the present disclosure are described above, it should be understood that those of ordinary skill in the art may make various changes, modifications, replacements and variations to these embodiments without departing from the principle and spirit of the present disclosure, and the scope of the present disclosure is subjected to the appended claims and legal equivalents thereof.

What is claimed is:

1. A nursing bra with an adhesive design, comprising a bra body and pads, wherein the bra body comprises a front side and a back side; and the pads are configured to shape breasts and prevent nipple show-through;

the front side of the bra body is provided with two cup structures; the two cup structures are provided with accommodating spaces; and the accommodating spaces have a shape matched with the pads; and the pads are semi-fixed in the accommodating spaces;

wherein the bra body further comprises straps; each of the straps and each of the two cup structures are connected or disconnected through each of nursing clips; and the straps are connected to top ends of the back side of the bra body.

2. The nursing bra with the adhesive design according to claim 1, wherein the pads are teardrop-shaped to gather the breasts.

3. The nursing bra with the adhesive design according to claim 1, wherein the two cup structures are provided with openings, wherein the pads are taken out or put in through the openings.

4. The nursing bra with the adhesive design according to claim 1, wherein the pads are adhered to bottom edges of the accommodating spaces.

5. The nursing bra with the adhesive design according to claim 1, wherein the bra body is formed by adhering two fabrics, wherein the two fabrics comprise a first fabric located at the front side of the bra body and a second fabric located at the back side of the bra body.

6. The nursing bra with the adhesive design according to claim 1, wherein the front side and the back side are connected; two ends of a connecting line between the front side and the back side are each sewn by bar tack; and a strengthening bar is provided on a back side of the connecting line to improve a structural strength.

7. A nursing bra with an adhesive design, comprising a bra body and pads, wherein the bra body comprises a front side and a back side; and the pads are configured to shape breasts and prevent nipple show-through;

the front side of the bra body is provided with two cup structures; the two cup structures are provided with accommodating spaces; and the accommodating spaces have a shape matched with the pads; and the pads are semi-fixed in the accommodating spaces;

wherein the bra body further comprises a W-shaped support; and the W-shaped support is located below the two cup structures to support the two cup structures.

8. A nursing bra with an adhesive design, comprising a bra body and pads, wherein the bra body comprises a front side and a back side; and the pads are configured to shape breasts and prevent nipple show-through;

the front side of the bra body is provided with two cup structures; the two cup structures are provided with accommodating spaces; and the accommodating spaces have a shape matched with the pads; and the pads are semi-fixed in the accommodating spaces;

wherein the bra body further comprises slings; and each of the slings has a first end connected to each of the nursing clips and a second end connected to a bottom of the bra body, and each of the slings is configured to connect and stabilize each of the straps.

9. The nursing bra with the adhesive design according to claim 8, wherein the bra body further comprises a double-clip structure composed of two nursing back clips; a first end of a first nursing back clip of the two nursing back clips is connected to each of the straps, and a first end of a second nursing back clip of the two nursing back clips is connected to each of the slings; and a second end of the first nursing back clip and a second end of the second nursing back clip are connected together, wherein the second end of the first nursing back clip and the second end of the second nursing back clip are not connected to the bra body.

10. The nursing bra with the adhesive design according to claim 1, wherein the bra body further comprises slings; and each of the slings has a first end connected to each of the nursing clips and a second end connected to a bottom of the bra body, and each of the slings is configured to connect and stabilize each of the straps.

* * * * *